US005916049A

United States Patent [19]

Wagner

[11] Patent Number: 5,916,049

[45] Date of Patent: Jun. 29, 1999

[54] PERMANENT FIELD MARKER

[76] Inventor: John N. Wagner, 24 Walnut Ave., Conyngham, Pa. 18219

[21] Appl. No.: 09/010,745

[22] Filed: Jan. 22, 1998

[51] Int. Cl.[6] ..... A63B 71/02

[52] U.S. Cl. ..... 473/490

[58] Field of Search ..... 473/490

[56] References Cited

U.S. PATENT DOCUMENTS 4,429,872 2/1984 Capachi ..... 473/490

*Primary Examiner*—William H. Grieb

[57] ABSTRACT

A new permanent field marker for permanently marking foul lines and sidelines for ball fields. The inventive device includes an elongated strip having a tab portion extending downwardly therefrom in an essentially orthogonal relationship with respect thereto. The tab portion extends a length of the elongated strip. A length of steel cable is secured to and extends a length of a free end of the tab portion. A pair of anchor spikes are secured to outer ends of the length of steel cable. The pair of anchor spikes are penetratable with respect to a recipient surface for securement of the length of cable and the elongated strip.

16 Claims, 2 Drawing Sheets

FIG. 1
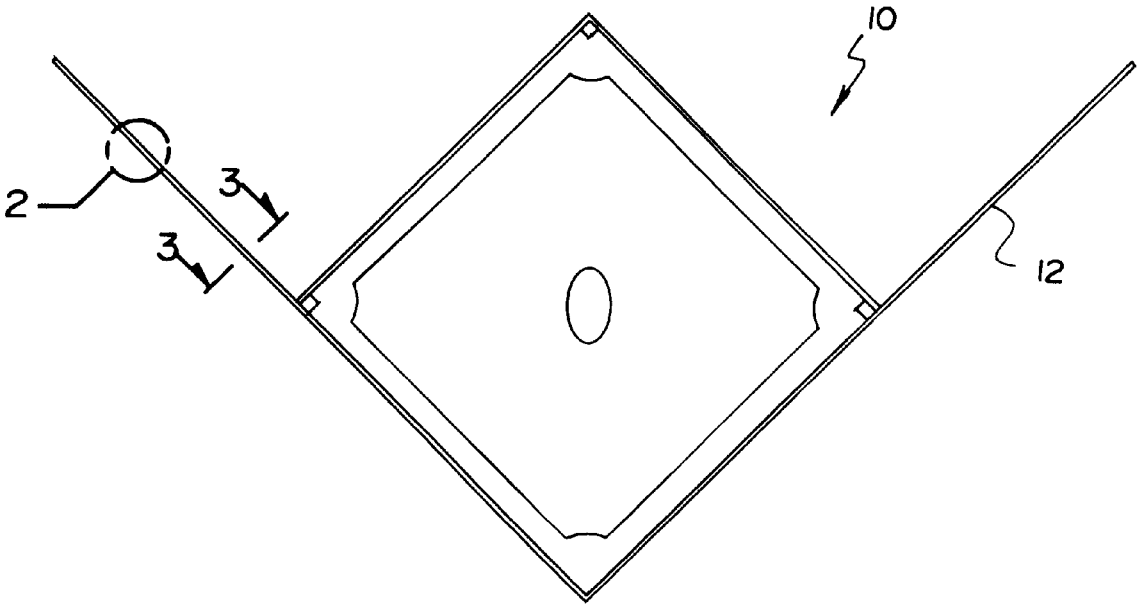
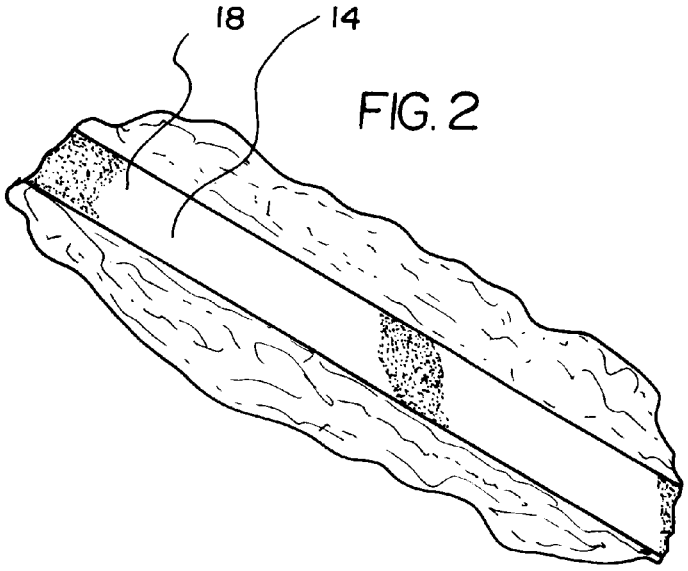
FIG. 2

PERMANENT FIELD MARKER

BACKGROUND OF THE INVENTION

1. Field of the Invention

The present invention relates to field markers and more particularly pertains to a new permanent field marker for permanently marking foul lines and sidelines for ball fields.

2. Description of the Prior Art

The use of field markers is known in the prior art. More specifically, field markers heretofore devised and utilized are known to consist basically of familiar, expected and obvious structural configurations, notwithstanding the myriad of designs encompassed by the crowded prior art which have been developed for the fulfillment of countless objectives and requirements.

Known prior art field markers include U.S. Pat. No. 4,103,886 to Eley; U.S. Pat. No. 4,218,059 to Eiden; U.S. Pat. No. 4,832,331 to Brandli; U.S. Pat. No. 4,826,062 to Buob et al.; U.S. Pat. No. Des. 338,699 to Bader; and U.S. Pat. No. 4,755,401 to Friedrich et al.

While these devices fulfill their respective, particular objectives and requirements, the aforementioned patents do not disclose a new permanent field marker. The inventive device includes an elongated strip having a tab portion extending downwardly therefrom in an essentially orthogonal relationship with respect thereto. The tab portion extends a length of the elongated strip. A length of steel cable is secured to and extends a length of a free end of the tab portion. A pair of anchor spikes are secured to outer ends of the length of steel cable. The pair of anchor spikes are penetratable with respect to a recipient surface for securement of the length of cable and the elongated strip.

In these respects, the permanent field marker according to the present invention substantially departs from the conventional concepts and designs of the prior art, and in so doing provides an apparatus primarily developed for the purpose of permanently foul lines and sidelines for ball fields.

SUMMARY OF THE INVENTION

In view of the foregoing disadvantages inherent in the known types of field markers now present in the prior art, the present invention provides a new permanent field marker construction wherein the same can be utilized for permanently foul lines and sidelines for ball fields.

The general purpose of the present invention, which will be described subsequently in greater detail, is to provide a new permanent field marker apparatus and method which has many of the advantages of the field markers mentioned heretofore and many novel features that result in a new permanent field marker which is not anticipated, rendered obvious, suggested, or even implied by any of the prior art field markers, either alone or in any combination thereof.

To attain this, the present invention generally comprises an elongated strip having a planar upper surface and a planar lower surface. The planar upper surface has a textured grip disposed thereon. The planar lower surface has a tab portion extending downwardly therefrom in an essentially orthogonal relationship with respect thereto. The tab portion extends a length of the elongated strip. A length of steel cable is secured to and extends a length of a free end of the tab portion. The length of cable is divided into a pair of elongated sections. The pair of elongated sections each have an outer end and an inner end. A turn buckle is disposed between the inner ends of the elongated sections of the length of steel cable. The turn buckle selectively lengthens and shortens an overall length of the length of steel cable. A pair of anchor spikes arc secured to the outer ends of the elongated sections of the length of steel cable. The pair of anchor spikes are penetratable with respect to a recipient surface for securement of the length of cable and the elongated strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in thc art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new permanent field marker apparatus and method which has many of the advantages of the field markers mentioned heretofore and many novel features that result in a new permanent field marker which is not anticipated, rendered obvious, suggested, or even implied by any of the prior art field markers, either alone or in any combination thereof.

It is another object of the present invention to provide a new permanent field marker which may be easily and efficiently manufactured and marketed.

It is a further object of the present invention to provide a new permanent field marker which is of a durable and reliable construction.

An even further object of the present invention is to provide a new permanent field marker which is susceptible of a low cost of manufacture with regard to both materials and labor, and which accordingly is then susceptible of low prices of sale to the consuming public, thereby making such permanent field marker economically available to the buying public.

Still yet another object of the present invention is to provide a new permanent field marker which provides in the apparatuses and methods of the prior art some of the advantages thereof, while simultaneously overcoming some of the disadvantages normally associated therewith.

Still another object of the present invention is to provide a new permanent field marker for permanently foul lines and sidelines for ball fields.

Yet another object of the present invention is to provide a new permanent field marker which includes an elongated strip having a tab portion extending downwardly therefrom in an essentially orthogonal relationship with respect thereto. The tab portion extends a length of the elongated strip. A length of steel cable is secured to and extends a length of a free end of the tab portion. A pair of anchor spikes are secured to outer ends of the length of steel cable. The pair of anchor spikes are penetratable with respect to a recipient surface for securement of the length of cable and the elongated strip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a new permanent field marker according to the present invention.

FIG. 2 is a sectional view of the present invention as taken from circle 2 of FIG. 1.

DESCRIPTION OF THE PREFERRED EMBODIMENT

Figure 3:
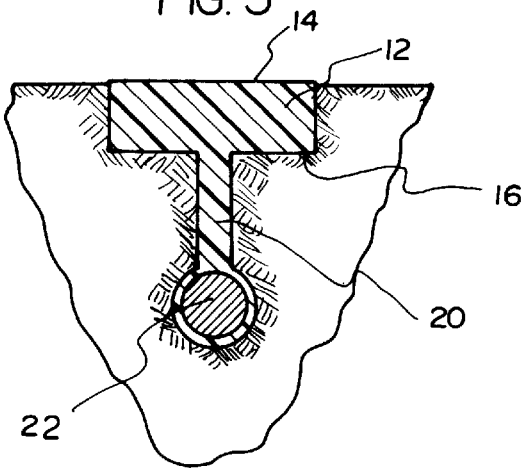
FIG. 3 is a cross-sectional view of the present invention as taken along line 3—3 of FIG. 1.
Figure 4:
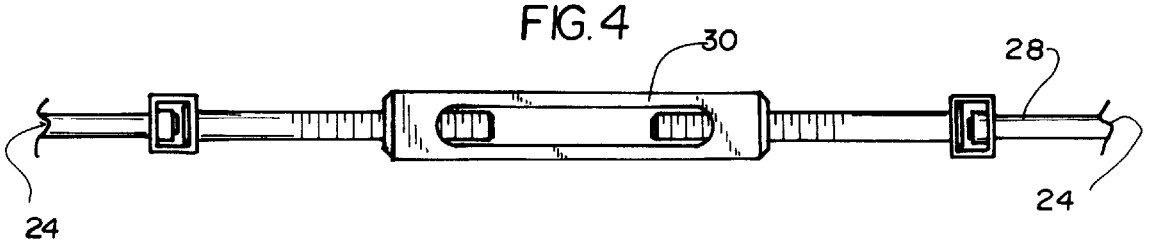
FIG. 4 is a plan view of the adjustment turn buckle of the present invention.
Figure 5:
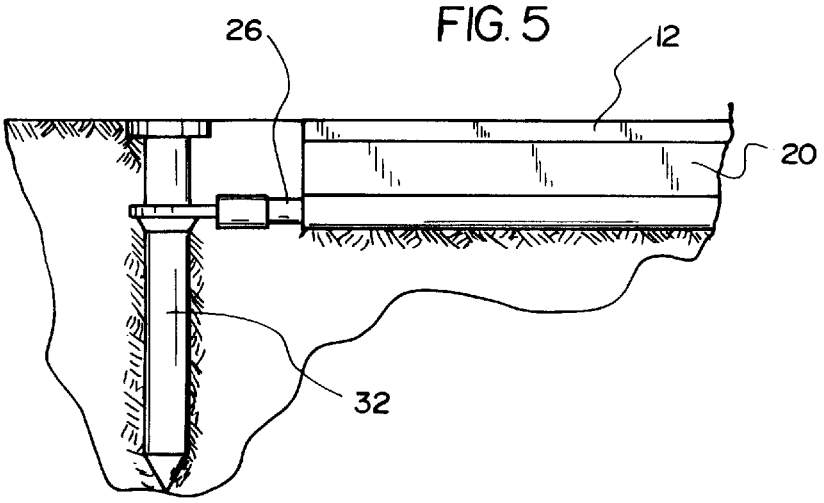
FIG. 5 is a side view of the anchor pin of the present invention.

With reference now to the drawings, and in particular to FIGS. 1 through 5 thereof, a new permanent field marker embodying the principles and concepts of the present invention and generally designated by the reference numeral 10 will be described.

As best illustrated in FIGS. 1 through 5, the permanent field marker 10 comprises an elongated strip 12 having a planar upper surface 14 and a planar lower surface 16. The planar upper surface 14 has a textured grip 18 disposed thereon. The planar lower surface 16 has a tab portion 20 extending downwardly therefrom in an essentially orthogonal relationship with respect thereto. The tab portion 20 extends a length of the elongated strip 12.

A length of steel cable 22 is secured to and extends greater than a length of a free end of the tab portion 20. The length of cable 22 is divided into a pair of elongated sections 24. The pair of elongated sections 24 each have an outer end 26 and an inner end 28.

A turn buckle 30 is disposed between the inner ends 28 of the elongated sections 24 of the length of steel cable 22. The turn buckle 30 selectively lengthens and shortens an overall length of the length of the steel cable 22.

A pair of anchor spikes 32 are secured to the outer ends 26 of the elongated sections 24 of the length of steel cable 22. The pair of anchor spikes 32 are penetratable with respect to a recipient surface for securement of the length of cable 22 and the elongated strip 12.

In use, the length of the elongated strip 12 would correspond with a length of a regulation foul line or a yardage marker or sidelines for football. The elongated strip 12 would lie flush with the ground while the length of cable 22 would be positioned below the elongated strip 12 within the ground. The anchor spikes 32 would secure the elongated strip 12 in place. One of the anchor spikes 32 would be positioned under home plate, in baseball, and the other spike would be positioned at the far end of the foul line adjacent to the foul pole. The turnbuckles 30 would be positioned between the sections comprising the length of cable 22 at a location for easy access, preferably beneath first base for one foul line and third base for the other foul line.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A permanent field marker system for permanently marking foul lines and sidelines for ball fields comprising, in combination:

an elongated strip having a planar upper surface and a planar lower surface, the planar upper surface having a textured grip disposed thereon, the planar lower surface having a tab portion extending downwardly therefrom in an essentially orthogonal relationship with respect thereto, the tab portion extending a length of the elongated strip;

wherein the planer upper surface of the elongated strip lies on a plane positioned above a ground surface;

a height of the elongated strip being defined between the upper and lower surfaces thereof, the tab portion of the elongates strip having opposite sides, a width of the tab portion being defined between the sides thereof, wherein the width of the tab portion is about ½ the height of the elongated strip;

a free end of the tab portion having a tube coupled thereto and extending a length of the tab portion, the tube having a bore, the tube having a generally circular transverse cross section taken perpendicular to a longitudinal axis of the tab portion;

a length of steel cable disposed in the bore of the tube of the tab portion and being secured to and extending greater than a length of a free end of the tab portion, the length of cable being divided into a pair of elongated sections, the pair of elongated sections each having an outer end and an inner end;

each of the inner ends of the elongated sections of the length of steel cable having a stop tab coupled thereto;

a turn buckle disposed between the inner ends of the elongated sections of the length of steel cable, the turn buckle selectively lengthening and shortening an overall length of the length of steel cable;

the turn buckle comprising an elongate twisting portion and a pair of elongate rods;

the twisting portion of the turn buckle having a cavity extending through a central portion thereof transverse to a longitudinal axis of the twisting portion, the twisting portion having a pair of threaded openings extending through opposite ends thereof along the longitudinal axis of the twisting portion and into the cavity of the twisting portion;

each of the elongate rods of the turn buckle having first and second ends, the first ends of the rods being threaded and being threadedly inserted in the threaded openings of the twisting portion, the second ends of each of the rods having an annular coupling ring coupled thereto, each of the coupling rings having a generally rectangular profile taken perpendicular to a longitudinal axes of the rods, each of the coupling rings having an aperture extending therethrough opposite the associated rod, the inner ends of the elongated sections of the length of steel cable extending through the apertures of the coupling rings such that the stop tabs of the inner ends of the length of steel cable are positioned inside the coupling rings;

a base adapted for use on a baseball field, the turn buckle being positioned under the base;

each of the outer ends of the elongated sections of the length of steel cable having an eyelet extending therefrom;

a pair of elongate anchor spikes extending through the eyelets of the outer ends of the elongated sections of the length of steel cable, the pair of anchor spikes being penetratable with respect to a recipient surface for securement of the length of steel cable and the elongated strip;

each of the anchor spikes having upper and lower ends the lower ends of each of the anchor spikes tapering downwardly to a tip, the upper ends of each of the anchor spikes having a peripheral flange extending therefrom generally perpendicular to a longitudinal axis of the associated anchor spike;

each of the anchor spikes having an annular tab extending therearound and positioned between the upper and lower ends thereof, the eyelets of the outer ends of the elongated sections of the length of steel cable resting on the annular tabs;

each of the annular tabs tapering outwardly towards the upper end of the associated anchor spike;

a length of each of the anchor spikes being defined between the upper and lower ends thereof, wherein the annular tab is positioned about 3/10 the length of the anchor spikes from the upper end of the associated anchor spike; and a home plate being adapted for use on a baseball field, one of the anchor spikes being positioned under the home plate.

2. The permanent field marker as set forth in claim 1 wherein the base is a first base.

3. The permanent field marker as set forth in claim 1 wherein the base is a third base.

4. A permanent field marker for permanently marking foul lines and sidelines for ball fields, comprising:

an elongated strip having a tab portion extending downwardly therefrom in an essentially orthogonal relationship with respect thereto, the tab portion extending a length of the elongated strip;

a length of steel cable secured to and extending greater than a length of a free end of the tab portion; and a pair of anchor spikes secured to outer ends of the length of steel cable, the pair of anchor spikes being penetratable with respect to a recipient surface for securement of the length of cable and the elongated strip.

5. The permanent field marker as set forth in claim 4 wherein the elongated strip has a textured grip disposed on an upper surface thereof.

6. The permanent field marker as set forth in claim 4 wherein the length of cable is divided into a pair of elongated sections.

7. The permanent field marker as set forth in claim 6 and further including a turn buckle disposed between inner ends of the elongated sections of the length of steel cable, the turn buckle selectively lengthening and shortening an overall length of the length of steel cable.

8. The permanent field marker as set forth in claim 7 wherein each of the inner ends of the elongated sections of the length of steel cable has a stop tab coupled thereto, the turn buckle comprising an elongate twisting portion and a pair of elongate rods, the twisting portion of the turn buckle having a cavity extending through a central portion thereof transverse to a longitudinal axis of the twisting portion, the twisting portion having a pair of threaded openings extending through opposite ends thereof along the longitudinal axis of the twisting portion and into the cavity of the twisting portion, each of the elongate rods of the turn buckle having first and second ends, the first ends of the rods being threaded and being threadedly inserted in the threaded openings of the twisting portion, the second ends of each of the rods having an annular coupling ring coupled thereto, each of the coupling rings having a generally rectangular profile taken perpendicular to a longitudinal axes of the rods, each of the coupling rings having an aperture extending therethrough opposite the associated rod, the inner ends of the elongated sections of the length of steel cable extending through the apertures of the coupling rings such that the stop tabs of the inner ends of the length of steel cable are positioned inside the coupling rings.

9. The permanent field marker as set forth in claim 6 wherein each of the outer ends of the elongated sections of the length of steel cable has an eyelet extending therefrom, the pair of elongate anchor spikes extending through the eyelets of the outer ends of the elongated sections of the length of steel cable.

10. The permanent field marker as set forth in claim 4 wherein the planer upper surface of the elongated strip lies on a plane positioned above a ground surface.

11. The permanent field marker as set forth in claim 4 wherein a height of the elongated strip is defined between the upper and lower surfaces thereof, the tab portion of the elongates strip having opposite sides, a width of the tab portion being defined between the sides thereof, wherein the width of the tab portion is about ½ the height of the elongated strip.

12. The permanent field marker as set forth in claim 4 wherein a free end of the tab portion has a tube coupled thereto and extending a length of the tab portion, the tube having a bore, the tube having a generally circular transverse cross section taken perpendicular to a longitudinal axis of the tab portion, the length of steel cable being disposed in the bore of the tube of the tab portion.

13. The permanent field marker as set forth in claim 4 wherein each of the anchor spikes has upper and lower ends, the lower ends of each of the anchor spikes tapering downwardly to a tip, the upper ends of each of the anchor spikes having a peripheral flange extending therefrom generally perpendicular to a longitudinal axis of the associated anchor spike.

14. The permanent field marker as set forth in claim 13 wherein each of the anchor spikes having an annular tab extending therearound and positioned between the upper and lower ends thereof, the eyelets of the outer ends of the elongated sections of the length of steel cable resting on the annular tabs.

15. The permanent field marker as set forth in claim 14 wherein each of the annular tabs tapering outwardly towards the upper end of the associated anchor spike.

16. The permanent field marker as set forth in claim 14 wherein a length of each of the anchor spikes being defined between the upper and lower ends thereof, wherein the annular tab is positioned about 3/10 the length of the anchor spikes from the upper end of the associated anchor spike.

* * * * *